US009586393B2

(12) United States Patent
Verkuijlen

(10) Patent No.: US 9,586,393 B2
(45) Date of Patent: Mar. 7, 2017

(54) ROTARY PRINTING MODULE AND PRINTING MACHINE PROVIDED WITH SUCH PRINTING MODULE

(71) Applicant: MPS HOLDING B.V., Arnhem (NL)

(72) Inventor: Adrianus Henricus Ignatius Maria Verkuijlen, Arnhem (NL)

(73) Assignee: MPS HOLDING B.V., Arnhem (NL)

( * ) Notice: Subject to any disclaimer, the term of this patent is extended or adjusted under 35 U.S.C. 154(b) by 0 days.

(21) Appl. No.: 14/910,232

(22) PCT Filed: Sep. 17, 2014

(86) PCT No.: PCT/NL2014/050635

§ 371 (c)(1),
(2) Date: Feb. 4, 2016

(87) PCT Pub. No.: WO2015/041521

PCT Pub. Date: Mar. 26, 2015

(65) Prior Publication Data

US 2016/0185099 A1 Jun. 30, 2016

(30) Foreign Application Priority Data

Sep. 18, 2013 (NL) ..... 2011465

(51) Int. Cl.
*B41F 5/24* (2006.01)
*B41F 3/54* (2006.01)
(Continued)

(52) U.S. Cl.
CPC ..... *B41F 3/54* (2013.01); *B41F 5/24* (2013.01); *B41F 13/24* (2013.01); *B41F 13/26* (2013.01);
(Continued)

(58) Field of Classification Search
CPC ..... B41F 13/24; B41F 13/26; B41F 13/34; B41F 3/54; B41F 13/32; B41F 13/36; B26D 2217/11; B26D 2217/14
See application file for complete search history.

(56) References Cited

U.S. PATENT DOCUMENTS

| | | | | |
|---|---|---|---|---|
| 4,878,427 | A | 11/1989 | Washchynsky et al. | |
| 2006/0117971 | A1* | 6/2006 | Wientjens | B41F 5/24 101/216 |
| 2008/0295723 | A1 | 12/2008 | Kuhn | |

FOREIGN PATENT DOCUMENTS

| | | |
|---|---|---|
| EP | 1 092 536 A1 | 4/2001 |
| EP | 1 285 753 A1 | 2/2003 |

(Continued)

*Primary Examiner* — Jill Culler
*Assistant Examiner* — Marissa Ferguson Samreth
(74) *Attorney, Agent, or Firm* — Birch, Stewart, Kolasch & Birch, LLP

(57) ABSTRACT

A printing module of the flexo printing type, is provided with an anilox roller and an impression roller which are set up between two frame parts. Further, the printing module comprises a plate cylinder assembly which is receivable in a plate cylinder holder assembly. The plate cylinder holder assembly is provided with a plate-shaped body part with a supporting ring support surface with a special curve which is symmetrical with respect to a curve plane. Further, each plate cylinder holder assembly comprises a body part support assembly via which the body part is connected with the associated frame part, wherein the body part support assembly is configured for pivoting the body part about a first imaginary pivoting axis and for pivoting the body part about a second imaginary pivoting axis, such as to allow a substantially independent distance setting between the plate cylinder and the anilox roller on one side and between the plate cylinder and the impression roller on the other side.

12 Claims, 5 Drawing Sheets

(51) Int. Cl.

| | |
|---|---|
| ***B41F 13/34*** | (2006.01) |
| ***B41F 13/26*** | (2006.01) |
| ***B41F 13/24*** | (2006.01) |
| ***B41F 13/32*** | (2006.01) |
| ***B41F 13/36*** | (2006.01) |
| ***B41F 13/40*** | (2006.01) |

(52) U.S. Cl.
CPC ..... *B41F 13/32* (2013.01); *B41F 13/34* (2013.01); *B41F 13/36* (2013.01); *B41F 13/40* (2013.01); *B41P 2217/11* (2013.01); *B41P 2217/14* (2013.01)

(56) References Cited

FOREIGN PATENT DOCUMENTS

| | | | |
|---|---|---|---|
| EP | 1 567 340 | A1 | 8/2005 |
| EP | 2 006 099 | A2 | 12/2008 |
| WO | WO 2004/050366 | A1 | 6/2004 |

* cited by examiner

ROTARY PRINTING MODULE AND PRINTING MACHINE PROVIDED WITH SUCH PRINTING MODULE

FIELD

The invention relates to a printing module, more particularly a printing module for the purpose of flexographic printing activities.

BACKGROUND

A flexographic printing module is described in EP-1 567 340 in applicant's name. The printing module known therefrom is a frame which comprises two opposite frame parts; an anilox roller which is bearing-mounted in the frame in a manner rotatable about an anilox roller axis and extends between the two opposite frame parts; an impression roller which is bearing-mounted in the frame in a manner rotatable about an impression roller axis and extends between the two opposite frame parts; and a plate cylinder assembly. The plate cylinder assembly comprises a stationary shaft; two supporting rings which are each connected with the shaft near an associated end of the shaft; and a plate cylinder which is mounted on the shaft in a manner rotatable about a plate cylinder axis. The diameter of the plate cylinder substantially corresponds to the diameter of the supporting rings. Further, the printing module comprises a first and a second plate cylinder holder assembly which are each connected with an associated frame part, and which are each configured for removably placing and fixing therein a supporting ring of the plate cylinder assembly. In this publication it is not described how on one side the distance and hence the pressure between the anilox roller and the plate cylinder and on the other side the distance and hence the pressure between the impression roller and the plate cylinder can be set.

For the setting problem, EP-1 092 536 A1 provides a solution. In that publication, each plate cylinder holder assembly is provided with two pivotable arms which each provide a support surface for the supporting ring associated with the respective plate cylinder holder assembly. The position of each pivotable arm is settable with a set screw. In total, the known printing module is provided with four independently settable arms, each with an associated set screw.

Also EP-1 285 753 A1 provides a solution to the setting problem. In this publication, as in EP-1 092 536 A1, a system is disclosed which utilizes four slidable or pivotable arms which are each associated with a corresponding set screw. These arms engage the supporting rings of the plate cylinder directly or via a support plate on which the shaft of the plate cylinder rests. The size of the support plate depends on the diameter of the plate cylinder. For each plate cylinder of a defined diameter, in that embodiment, a corresponding support plate is present. Accordingly, such an embodiment involves a set of exchangeable support plates of mutually different dimensions.

The constructions known from EP'753 and EP'536 are complicated and also costly. Moreover, the independent setting of the two distances on either side of the printing module with four set screws is laborious and time consuming. The rear set screws are poorly accessible to the machine operator. As four pivotable arms are employed, the support geometry is not guaranteed, that is, the points of support by which supporting rings abut against the arms may, as a result of improper setting, be set such that the plate cylinder is not positioned centrally between the anilox roller and the impression roller anymore. Such a non-central positioning can have an adverse influence on the printing quality. Since the setting needs to be done accurately for a good printing result, and standstill of the machine leads to production loss and hence additional costs, the proposed solution is susceptible of improvement.

To that end, the invention provides a printing module according to claim 1, in other words, a printing module of the type described above with reference to EP-1 567 340, which is characterized in that each plate cylinder holder assembly comprises a plate-shaped body part which extends in an imaginary body part plane which extends perpendicular to the plate cylinder axis, wherein a side of the plate-shaped body part proximal to the plate cylinder axis forms a supporting ring support surface which extends substantially perpendicular to the body part plane and runs along a curve which extends in the body part plane, wherein the curve is mirror-symmetrical with respect to an imaginary curve symmetry plane which extends substantially perpendicular to the body part plane, and with respect to which the anilox roller axis and impression roller axis are disposed substantially symmetrically, and in which the plate cylinder axis extends. The curve, viewed from the plate cylinder axis, comprises a central concave curve part which is symmetrical with respect to the central curve symmetry plane; a first convex curve part which adjoins a first end of the concave curve part and which extends to a first convex free end; and a second convex curve part which adjoins a second end of the concave curve part and which extends to a second convex free end, wherein the two convex parts are symmetrical with respect to the curve symmetry plane. Further, each plate cylinder holder assembly comprises a body part support assembly via which the body part is connected with the associated frame part, wherein the body part support assembly is configured for pivoting the body part about a first pivoting axis and for pivoting the body part about a second pivoting axis. The first and second pivoting axes are positioned symmetrically on opposite sides of the curve symmetry plane. The first pivoting axis substantially coincides with the impression roller axis, that is, coincides exactly with the impression roller axis or extends parallel to the impression roller axis with the distance between the first pivoting axis and impression roller axis being less than 50 mm. The second pivoting axis substantially coincides with the anilox roller axis, that is, coincides exactly with the anilox roller axis or extends parallel to the anilox roller axis with the distance between the second pivoting axis and anilox roller axis being less than 50 mm.

Owing to the specific pivoting possibility about two pivoting axes and the above-defined positioning of the pivoting axes, it is possible to set the distance between the plate cylinder and the anilox roller without the distance between the plate cylinder and the impression roller being significantly influenced. Consequently, first the distance between the plate cylinder and the anilox roller can be set and then the distance between the plate cylinder and the impression roller. When this latter setting takes place, this does not disturb the previous setting of the distance between the plate cylinder and the anilox roller. Moreover, with the printing module according to the invention it can be guaranteed that the plate cylinder is always substantially centered between the anilox roller and the impression roller. This is because per plate cylinder holder assembly there is only one body part involved whose curve offers two points of support for the associated supporting ring. This is in contrast to the proposal from EP-1 092 536 A1 where for each point of support a separate pivoting arm is provided. Moreover, the printing module according to the invention, as regards the number of construction parts, is simpler and more robust.

The invention further provides a printing machine which is provided with a number of printing modules set up in series behind each other, while at least one of the printing modules is a printing module according to the invention.

Further elaborations of the invention are described in the subclaims and will hereinafter be clarified, on the basis of an exemplary embodiment, with reference to the drawings.

It is noted that the embodiments are not limited to the examples that are shown in the drawings. The drawings serve for clarification only. The embodiments can be employed independently of each other. Also, it is possible that several embodiments of the invention are embodied in a single printing module.

DETAILED DESCRIPTION

Figure 1:
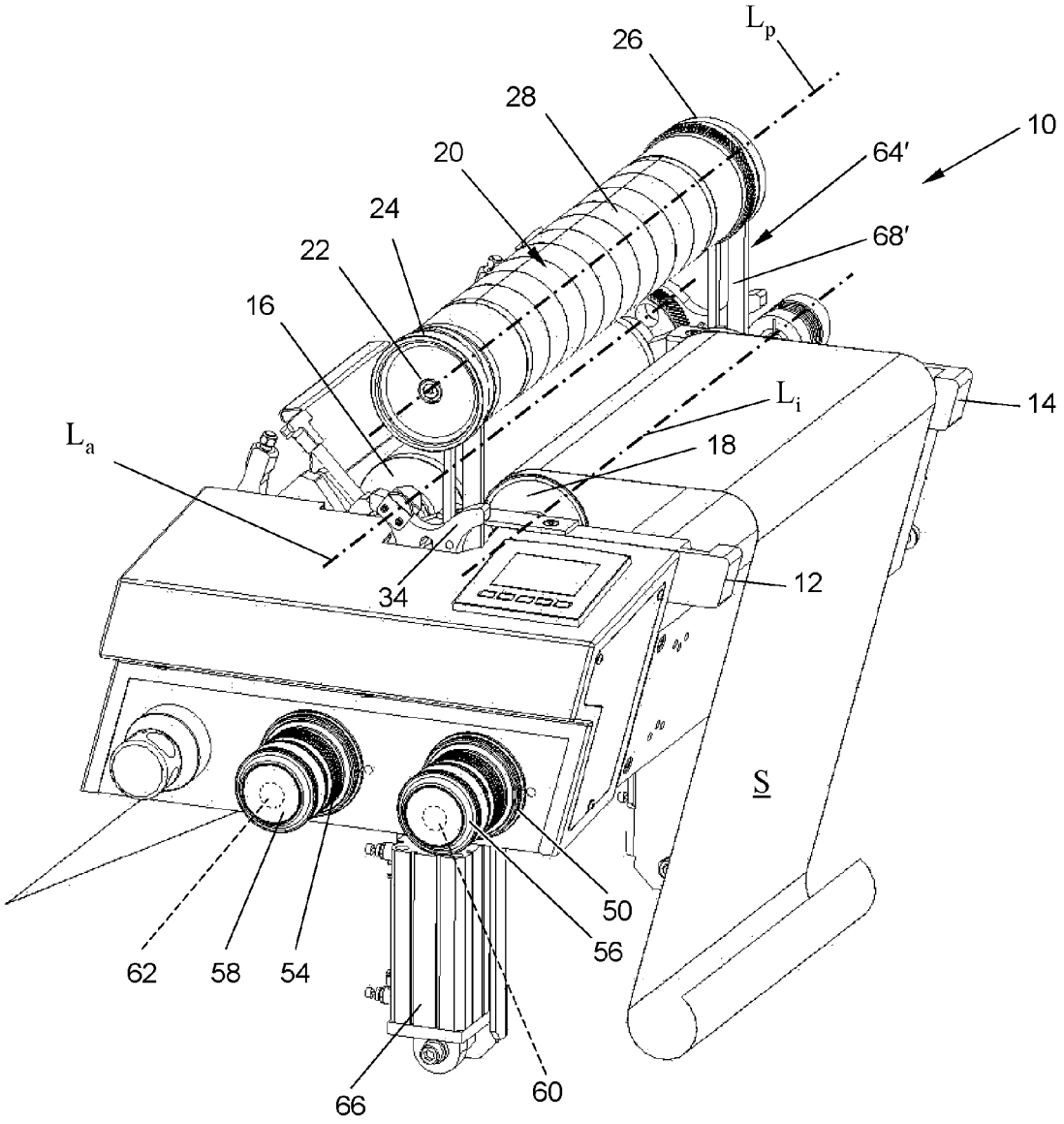
FIG. 1 shows a perspective view of an exemplary embodiment of a printing module.
Figure 2:
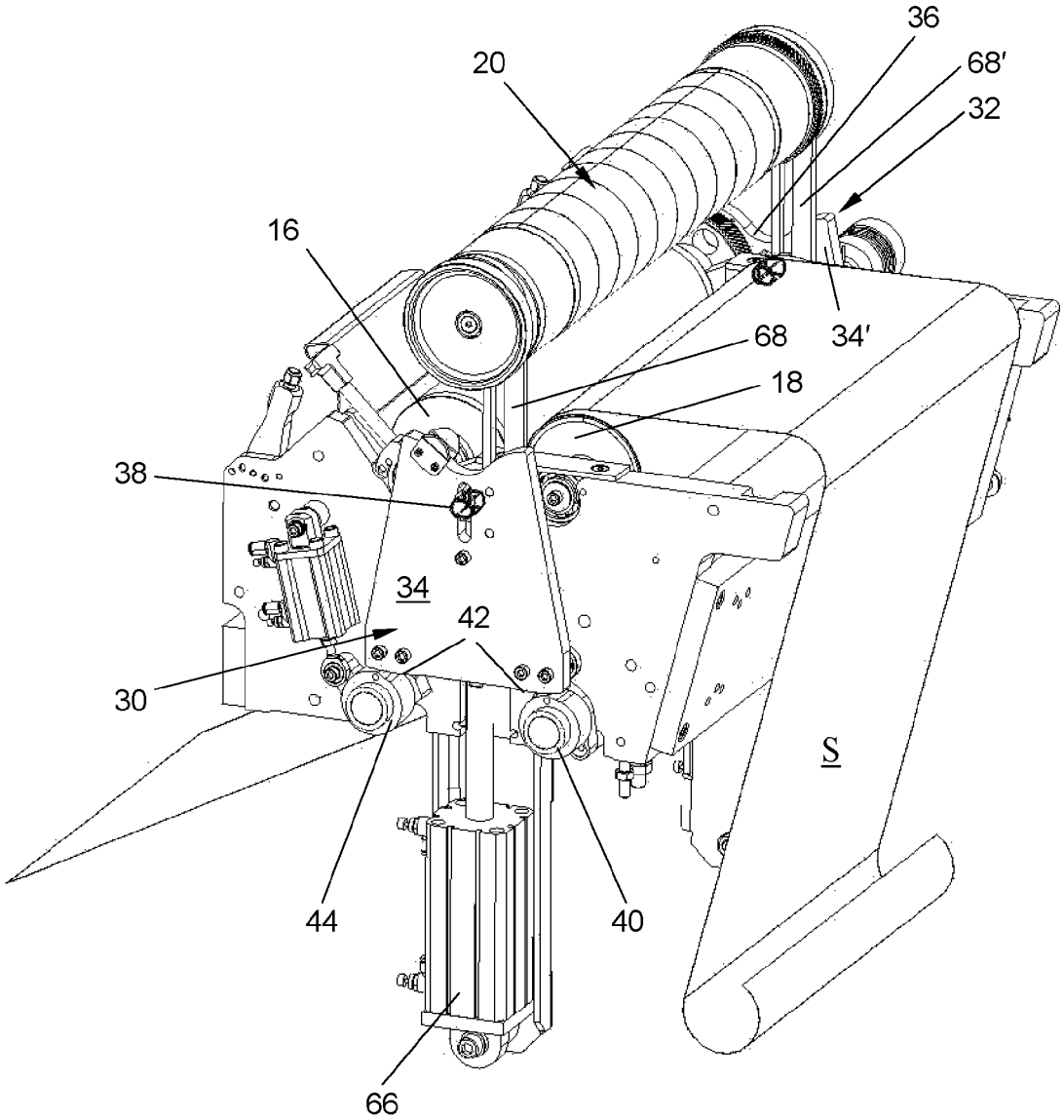
FIG. 2 shows a similar perspective view of the printing module represented in FIG. 1, with a part of the encasing of the printing module removed.
Figure 3:
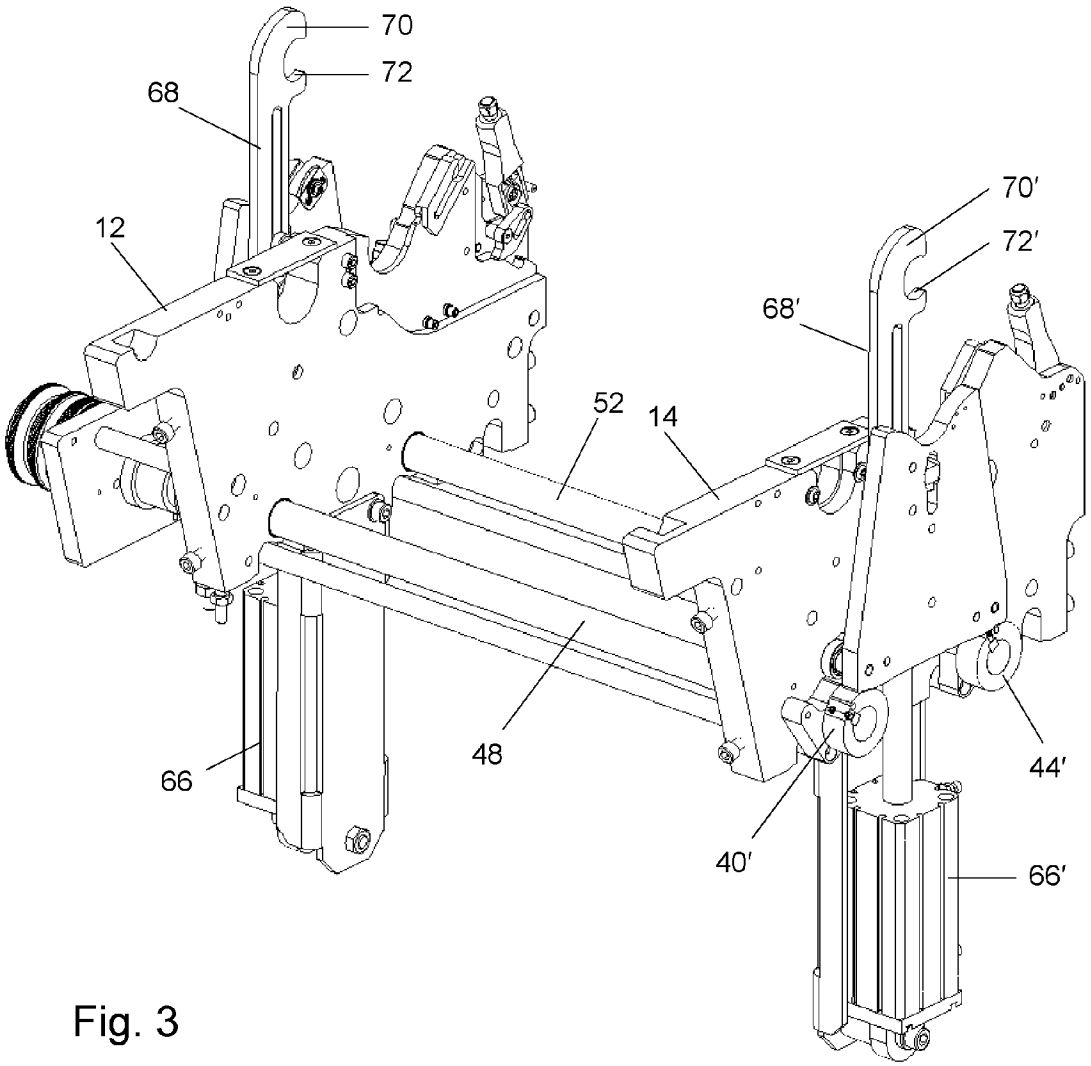
FIG. 3 shows a perspective view of the printing module represented in FIGS. 1 and 2 from a different viewpoint, with a part of the encasing and a number of parts of the printing module removed.
Figure 4:
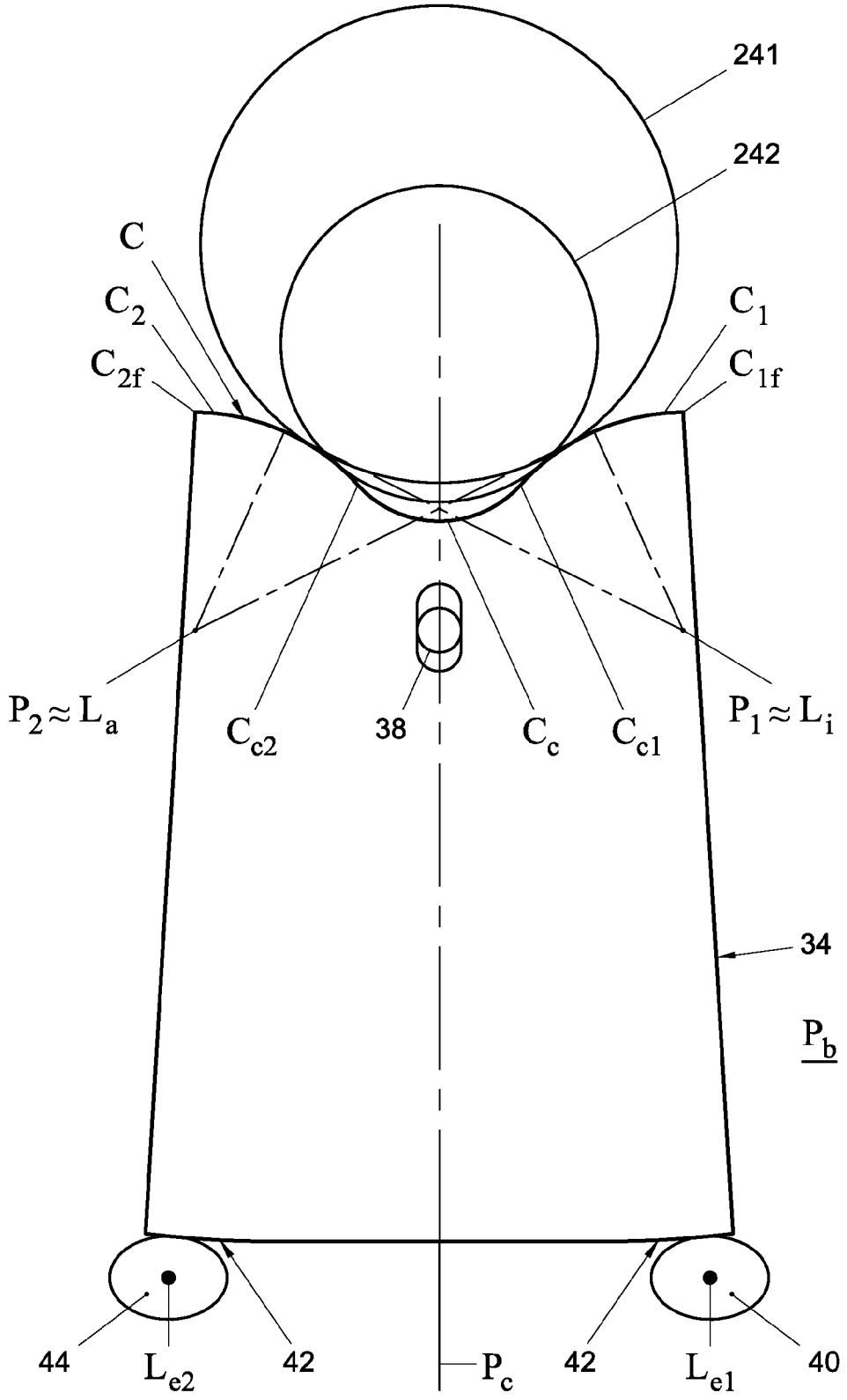
FIG. 4 shows a schematic front view of the plate cylinder holder assembly, more particularly of the body part and the eccentric cams thereof, while further two plate cylinder assemblies are depicted with different diameters.
Figure 5:
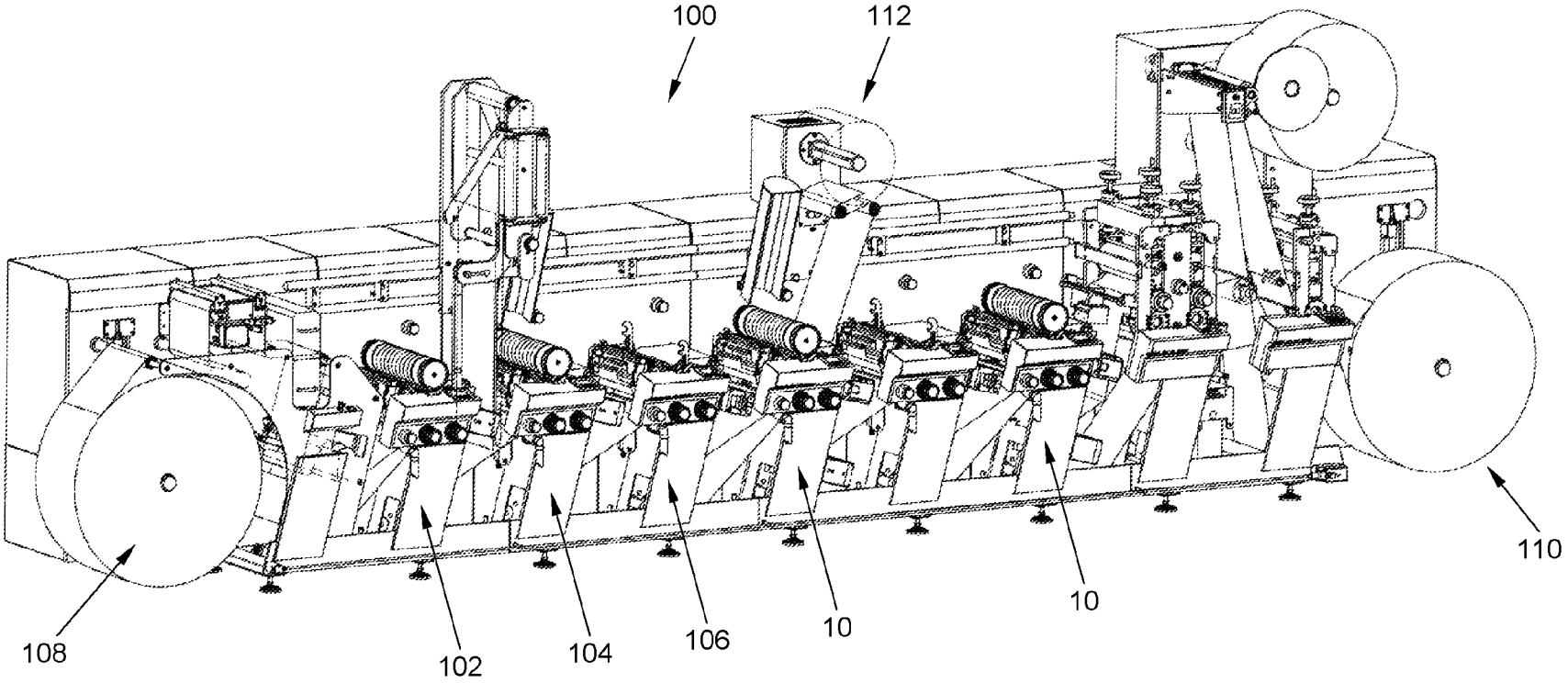
FIG. 5 shows an example of a printing machine with a number of printing modules set up in line.

In the most general terms, the invention, of which an example is shown in the figures, relates to a printing module 10 which is provided with a frame which comprises two opposite frame parts 12, 14. Further, the printing module 10 comprises an anilox roller which is bearing-mounted in the frame in a manner rotatable about an anilox roller axis $L_a$ and extends between the two opposite frame parts 12, 14. Further, an impression roller 18 is present which is bearing-mounted in the frame in a manner rotatable about an impression roller axis $L_i$ and which extends between the two opposite frame parts 12, 14. The printing module 10 is provided with a plate cylinder assembly 20 which comprises a stationary shaft 22, two supporting rings 24, 26 which are each connected with the shaft 22 near an associated end of the shaft 22, and a plate cylinder 28 which is mounted on the shaft 22 in a manner rotatable about a plate cylinder axis $L_p$. The diameter of the plate cylinder 28 substantially corresponds to the diameter of the supporting rings 24, 26. The advantage of this will be discussed hereinafter. Finally, the printing module 10 comprises a first and a second plate cylinder holder assembly 30, 32 which are each connected with an associated frame part 12, 14 and which are each configured for removably placing and fixing therein a supporting ring 24, 26 of the plate cylinder assembly 20. Such a printing module 10 is referred to in practice as a flexo printing module. A flexographic printing technique is used, whereby a printing plate with a print image is fitted to the plate cylinder. Ink is provided on the anilox roller via an ink assembly. This can take place in different manners, which are known from practice and the literature. The anilox roller can for instance be provided with ink by a fountain roll which takes up ink from an ink reservoir. From practice, however, also direct-inking systems are known, whereby the ink is applied not from a reservoir but via a supply opening directly onto the anilox roller. The anilox roller takes up a specific amount of ink from the fountain roll and in turn transfers it to the higher-located parts of the printing plate. Thereupon, the ink is transferred from the higher-located parts to a substrate web S which is passed between the plate cylinder and the impression roller. Thus a print image is formed on the substrate web S. When multicolor printing is desired, use is made of a number of printing modules 10 set up in series behind each other, whereby each printing module 10 provides a print image in a different color. A printing machine 100 may, in addition to printing modules 10 according to the invention, also comprise other printing modules 102, 104, 106, such as, for instance, screen printing modules, offset printing modules, laminating and delaminating modules 112 for, respectively, applying and removing e.g. metal foils onto and from the substrate S. Further, the printing machine 100 is generally provided at an upstream end thereof with a substrate web unwinding module 108 and at a downstream end thereof with a substrate web rewinding module 110.

The features of a printing module 10 enumerated above in the detailed description are known from practice.

The present printing module 10 is characterized according to the invention in that each plate cylinder holder assembly 30, 32 comprises a plate-shaped body part 34 which extends in an imaginary body part plane $P_b$ which extends perpendicular to the plate cylinder axis $L_p$. A side of the plate-shaped body part 34 proximal to the plate cylinder axis $L_p$ forms a supporting ring support surface 36 which extends substantially perpendicular to the body part plane $P_b$ and runs along a curve C which extends in the body part plane $P_b$. The curve C is mirror-symmetrical with respect to an imaginary curve symmetry plane $P_c$ which extends substantially perpendicular to the body part plane $P_b$, and with respect to which the anilox roller axis $L_a$ and impression roller axis $L_i$ are substantially symmetrically positioned, and in which the plate cylinder axis $L_p$ extends. The curve C comprises, viewed from the plate cylinder axis $L_p$, a central concave curve part $C_c$ which is symmetrical with respect to the central curve symmetry plane $P_c$. Further, the curve C comprises a first convex curve part $C_1$ which adjoins a first end $C_{c1}$ of the concave curve part $C_c$ and which extends to a first convex free end $C_{1f}$. Further, the curve C comprises a second convex curve part $C_2$ which adjoins a second end $C_{c2}$ of the concave curve part $C_c$ and which extends to a second convex free end $C_{2f}$. The two convex parts $C_1$, $C_2$ are symmetrical with respect to the curve symmetry plane $P_c$. What can be accomplished with such a curve C is that a plate cylinder assembly 20 which comprises supporting rings 24, 26 whose diameter substantially corresponds to the diameter of the plate cylinder 28 is always, that is, given different diameters of the plate cylinder 28, centered with respect to the anilox roller 16 and the impression roller 18, and that the distance between plate cylinder 28 and anilox roller 16 on one side and between plate cylinder 28 and impression roller 18 on the other side is directly substantially correct. Only for setting the proper pressure between anilox roller 16 and plate cylinder 28 and between plate cylinder 28 and impression roller 18 is a small setting possibility still desired. To this end, the printing module is further characterized in that it comprises a body part support assembly via which the body part 34 is connected with the associated frame part 12, 14. The body part support assembly is configured for pivoting the body part 34 about a first imaginary pivoting axis $P_1$ and for pivoting the body part about a second imaginary pivoting axis $P_2$. The first and second pivoting axes $P_1$, $P_2$ are positioned symmetrically on opposite sides of the curve symmetry plane $P_c$. The first pivoting axis $P_i$ substantially coincides with the impression roller axis $L_i$, that is, coincides exactly with the impression roller axis $L_i$ or extends parallel to the impression roller axis $L_i$ with the distance between the first pivoting axis $P_1$ and impression roller axis $L_i$ being less than 50 mm. The second pivoting axis $P_2$ substantially coincides with the anilox roller axis $L_a$, that is, coincides exactly with the anilox roller axis $L_a$ or extends parallel to the anilox roller axis $L_a$ with the distance between the second pivoting axis $P_2$ and anilox roller axis $L_a$ being less than 50 mm.

As already indicated above, through this specific pivoting possibility about two pivoting axes $P_1$ and $P_2$, a substantially independent distance setting between, on one side, plate cylinder 28 and anilox roller 16 and, on the other side, plate cylinder 28 and impression roller 18 can be effected. For when the body part 34 is pivoted about the first pivoting axis $P_1$, the supporting ring 24 and hence the plate cylinder 28 is moved substantially perpendicular with respect to the anilox roller surface at the point of contact, so that the plate cylinder 28 is in actual fact moved away from the anilox roller 16 or is moved towards it. The movement of the plate cylinder 28 with respect to the impression roller 18 proceeds much more tangentially along the surface of the impression roller 18 at the point of contact, so that no, or hardly any, distance change occurs there. When pivoting is done about the second pivoting axis $P_2$, the opposite effect occurs, so that the distance between the plate cylinder 28 and the impression roller 18 is set and hardly any distance change takes place between the plate cylinder 28 and the anilox roller 16.

In an embodiment, of which an example is shown in the figures, the body part support assembly can comprise a central pivoting shaft 38 which is connected with the associated frame part 12, 14 and an axis of which extends in the imaginary curve symmetry plane $P_c$ and is parallel to the plate cylinder axis $L_p$. In that embodiment, the central pivoting shaft 38 is so connected with the body part 34 that the body part 34 is at least pivotable about the central pivoting shaft 38. Further, the embodiment in question comprises an actuator assembly which engages the body part 34 and which is configured for pivoting the body part 34 about the first pivoting axis $P_1$ and the second pivoting axis $P_2$.

In an embodiment, of which an example is shown in the figures, the actuator assembly may be arranged for pivoting the body part 34 of the first plate cylinder holder assembly 30 and for pivoting the body part 34' of the second plate cylinder holder assembly 32. The actuator assembly may then be provided with coupling means, which have a coupled condition in which the pivoting of the first and the second body part 34, 34' is coupled and which have an uncoupled condition in which the pivoting of the first and second body part 34, 34' independently of each other is possible.

Through the presence of such coupling means, in a coupled condition, the position of the plate cylinder 28 can be adjusted without the direction of the plate cylinder axis $L_p$ changing. This can be effected, for instance, by turning only one knob which is at the front of the module which is easily accessible to an operator. When the plate cylinder axis $L_p$ is not directed parallel to, for instance, the anilox roller axis $L_a$, the coupling means can be uncoupled and the relative skew can be corrected by pivoting the body part 34' of the second plate cylinder holder assembly 32 independently about the first pivoting axis $P_1$, while the body part 34 of the first plate cylinder holder assembly 30 is not adjusted.

In an embodiment of the invention, of which an example is shown in the figures, the actuator assembly can comprise a first eccentric cam 40 which engages an eccentric support surface 42 of the body part 34, which is located opposite the supporting ring support surface 36 and which extends substantially perpendicular to the body part plane $P_b$. The eccentric cam 40 is rotatable about a first eccentric axis $L_{e1}$, which extends substantially parallel to the plate cylinder axis $L_p$. Further, the actuator assembly comprises a second eccentric cam 44 which also engages the eccentric support surface 42 of the body part 34 and which is rotatable about a second eccentric axis $L_{e2}$, which extends substantially parallel to the plate cylinder axis $L_p$. The first and the second eccentric cams 40, 44 and the associated first and second eccentric axes $L_{e1}$, $L_{e2}$ are positioned mirror-symmetrically with respect to the curve symmetry plane $P_c$. The embodiment in question further comprises a slot 46 in the body part 34 in which the pivoting shaft 38 is received. The slot has a width substantially corresponding to the diameter of the central pivoting shaft 38 and has a length that is greater than the diameter of the central pivoting shaft 38. The slot 46 has, in the length direction, a longitudinal axis which is in the curve symmetry plane $P_c$, such that the body part 34 is not only pivotable about the central pivoting shaft 38 but also translatable along the central pivoting shaft 38.

What is accomplished by virtue of the central pivoting shaft 38 is that the body plate 34 is always substantially centered between the anilox roller 16 and the impression roller 18. As the body plate 34 is further provided with the above-described curve C, it is further accomplished that the plate cylinder 28 in each case is substantially centrally positioned between the anilox roller 16 and the impression roller 18. The body plate 34 rests on the eccentric cams 40, 44. Upon rotation of one of the eccentric cams 40, 44, the body plate 34 pivots to some extent about the central pivoting shaft 38 and the body plate 34 also translates to some extent along the central pivoting shaft 38. Also, a minor translation movement of between the body plate 34 and the other eccentric cam 44, 40 that is not rotated, takes place. Adjacent the contact area between the eccentric cams 40, 44 on the one hand and the eccentric support surface 42 on the other, the eccentric support surface 42 may be provided with a convex curve, viewed from the respective eccentric cam 40, 44, in order to keep the first and second pivoting axes $P_1$, $P_2$ in the desired position during rotation of an eccentric cam 40, 44. Through the combined translation and rotation, actually a pure rotation takes place about the first, or second, pivoting axis $P_1$, $P_2$.

In an embodiment, of which an example is shown in the figures, the printing module 10 may be provided with a first eccentric cam connecting shaft 48 which is connected with the first eccentric cam 40' of the second plate cylinder holder assembly 32 and which extends from the second frame part 14 to the first frame part 12 and which near the first frame part 12 is provided with a first operating knob 50 with the aid of which the first eccentric cam 40' of the second plate cylinder holder assembly 32 is adjustable. Such an embodiment may further be provided with a second eccentric cam connecting shaft 52 which is connected with the second eccentric cam 44' of the second plate cylinder holder assembly 32 and which extends from the second frame part 14 to the first frame part 12 and which near the first frame part 12 is provided with a second operating knob 54 with the aid of which the second eccentric cam 44' of the second plate cylinder holder assembly 32 is adjustable. A third operating knob 56 may be connected with the first eccentric cam 40 of the first plate cylinder holder assembly 30. With the aid of the third operating knob 56 the first eccentric cam 40 of the first plate cylinder holder assembly 30 may be adjustable. Finally, the printing module 10 may be provided with a fourth operating knob 58 which is connected with the second eccentric cam 44 of the first plate cylinder holder assembly 30. With the aid of the fourth operating knob 58, the second eccentric cam 44 of the first plate cylinder holder assembly 30 may be adjustable.

Through such an implementation, the operator of the printing machine of which the printing module 10 is a part can operate both the body part 34' of the second plate cylinder holder assembly 32 and the body part 34 of the first plate cylinder holder assembly 30 from a front of the printing module 10. The operator hence does not need to reach over the substrate web to adjust the rear body plate 34' of the second plate cylinder holder assembly. From the viewpoint of convenience, but also from the viewpoint of setting speed and setting accuracy, this is of benefit.

In an embodiment, of which an example is shown in the figures, and which forms a further elaboration of the above-described embodiment with the first and second eccentric cam connecting shafts 48, 52, and which is provided with the above-described coupling means for adjusting the two body plates 34, 34' simultaneously and independently of each other, the coupling means can comprise a first coupling 60 between the third operating knob 56 and the first eccentric cam connecting shaft 48 or the first operating knob 50 mounted thereon. The first coupling 60 may be so configured that in a coupled condition of the first coupling 60 the two first eccentric cams 40, 40' are operated simultaneously, and in an uncoupled condition of the first coupling 60 are operable independently of each other. Further, the embodiment may be provided with a second coupling 62 between the fourth operating knob 58 and the second eccentric cam connecting shaft 52 or the second operating knob 54 mounted thereon. This second coupling 62 may be so configured that in a coupled condition of the second coupling 62 the two second eccentric cams 44, 44' are operated simultaneously and in an uncoupled condition of the second coupling 62 are operable independently of each other.

In an embodiment, of which an example is shown in the figures, each plate cylinder holder assembly 30, 32 may be provided with an associated hold-down 64, 64' which engages the supporting ring 24, 26 or a freely accessible part of the stationary shaft 22. This can be, for instance, a part of the stationary shaft 22 that extends between the respective supporting ring 24, 26 and the plate cylinder 28.

With the aid of such a hold-down 64, 64', the plate cylinder assembly 20 is fixed in the plate cylinder holder assemblies 30, 32 in that the supporting rings 24, 26 are pulled or pressed against the curve C, C' of the body parts 34, 34'.

According to an embodiment, of which an example is shown in the figures, each hold-down 64, 64' can comprise a piston/cylinder assembly 66 and an associated pull rod 68. The pull rod 68 may be provided, near one end, with a hook 70 which in a retracted condition engages the above-mentioned freely accessible part of the stationary shaft 22, such that the supporting rings 24, 26 are pulled or pushed against the supporting ring support surface 36.

In an embodiment, the pull rod 68 of each hold-down 64, 64' may further be provided with a bearing surface 72 which is so designed that, in a pushed-out condition of the pull rod 68, it engages the freely accessible part of the stationary shaft 22, such that the plate cylinder assembly 20 is lifted and the supporting rings 24, 26 are moved away from the supporting ring support surface 36 of the body part 34.

Thus, the plate cylinder assembly 20 can be simply taken out of the printing module 10 and be exchanged for another plate cylinder assembly 20 which, for instance, carries another printing plate and has a different diameter.

In the embodiment with the eccentric cams 40, 44, 40', 44', the pull force exerted by the pull rods 68, 68' of the hold-downs 64, 64' will be taken up via the supporting rings 24, 26 and the body parts 34, 34' by the eccentric cams 40, 44, 40', 44'.

Thus, a stable, simply settable plate cylinder holder assembly 30, 32 is provided which enables a substantially independent setting of the distance between the plate cylinder 28 and the anilox roller 16 and the distance between the plate cylinder 28 and the impression roller 18, while it is further accomplished that the plate cylinder 28 is always received in substantially centered position between the anilox roller 16 and the impression roller 18. All this is possible with a minimum number of parts and with an optimal convenience of use, so that obtaining a proper setting can take place in a short time and hence with little production loss of the printing machine of which the printing module 10 is a part.

The invention further provides a printing machine 100 provided with a number of printing modules 102, 104, 106, set up in series behind each other, while at least one of the printing modules is a printing module 10 according to the invention. The various embodiments described hereinabove and most of which are claimed in the subclaims can be used independently of each other and be combined with each other in different ways. The drawings to which reference is made in the description of the embodiments only serve as an example of a possible implementation of the various embodiments. The reference signs in the claims do not limit the claims and are for clarification only.

ELEMENT LIST

10. printing module
12. frame part
14. frame part
16. anilox roller
18. impression roller
20. plate cylinder assembly
22. stationary shaft
24. supporting ring
26. supporting ring
28. plate cylinder
30. first plate cylinder holder assembly
32. second plate cylinder holder assembly
34. plate-shaped body part of first plate cylinder holder assembly
34'. plate-shaped body part of second plate cylinder holder assembly
36. supporting ring support surface
38. central pivoting shaft
40. first eccentric cam of first plate cylinder holder assembly
40'. first eccentric cam of second plate cylinder holder assembly
42. eccentric support surface
44. second eccentric cam of first plate cylinder holder assembly

44'. second eccentric cam of second plate cylinder holder assembly
46. slot
48. first eccentric cam connecting shaft
50. first operating knob
52. second eccentric cam connecting shaft
54. second operating knob
56. third operating knob
58. fourth operating knob
60. first coupling
62. second coupling
64. hold-down of first plate cylinder holder assembly
64'. hold-down of second plate cylinder holder assembly
66. piston-cylinder assembly
68. pull rod of first plate cylinder holder assembly
68'. pull rod of second plate cylinder holder assembly
70. hook
72. bearing surface
$L_a$. anilox roller axis
$L_i$. impression roller axis
$L_p$. plate cylinder axis
$P_b$. body part plane
C. curve
$P_c$. curve symmetry plane
$C_c$. central concave curve part
$C_1$. first convex curve part
$C_{c1}$. first end of the concave curve part $C_c$
$C_{1f}$. free end of the first convex curve part $C_1$
$C_2$. second convex curve part
$C_{c2}$. second end of the concave curve part Cc
$C_{2f}$. free end of the second convex curve part $C_2$
$P_1$. first imaginary pivoting axis
$P_2$. second imaginary pivoting axis
$L_{e1}$. first eccentric axis
$L_{e2}$. second eccentric axis

The invention claimed is:

1. A printing module comprising:

a frame which comprises two opposite frame parts;

an anilox roller which is bearing-mounted in the frame in a manner rotatable about an anilox roller axis and extends between the two opposite frame parts;

an impression roller which is bearing-mounted in the frame in a manner rotatable about an impression roller axis and extends between the two opposite frame parts;

a plate cylinder assembly comprising:

a stationary shaft;

two supporting rings which are each connected with the shaft near an associated end of the shaft; and a plate cylinder which is mounted on the shaft in a manner rotatable about a plate cylinder axis, the diameter of the plate cylinder substantially corresponding to the diameter of the supporting rings;

a first and a second plate cylinder holder assembly which are each connected with an associated frame part, and which are each configured for removably placing and fixing therein a supporting ring of the plate cylinder assembly;

wherein each plate cylinder holder assembly comprises:

a plate-shaped body part which extends in an imaginary body part plane which extends perpendicular to the plate cylinder axis, wherein a side of the plate-shaped body part proximal to the plate cylinder axis forms a supporting ring support surface which extends substantially perpendicular to the body part plane and runs along a curve which extends in the body part plane, wherein the curve is mirror-symmetrical with respect to an imaginary curve symmetry plane which extends substantially perpendicular to the body part plane and with respect to which the anilox roller axis and impression roller axis are substantially symmetrically positioned and in which the plate cylinder axis extends, wherein the curve, viewed from the plate cylinder axis, comprises:

a central concave curve part which is symmetrical with respect to the central curve symmetry plane;

a first convex curve part which adjoins a first end of the concave curve part and which extends to a first convex free end; and a second convex curve part which adjoins a second end of the concave curve part and which extends to a second convex free end, the two convex parts being symmetrical with respect to the curve symmetry plane; and a body part support assembly via which the body part is connected with the associated frame part, wherein the body part support assembly is configured for pivoting the body part about a first pivoting axis and for pivoting the body part about a second pivoting axis, wherein the first and second pivoting axes are symmetrically positioned on opposite sides of the curve symmetry plane, wherein the first pivoting axis substantially coincides with the impression roller axis, that is, coincides exactly with the impression roller axis or extends parallel to the impression roller axis with the distance between the first pivoting axis and impression roller axis being less than 50 mm, and wherein the second pivoting axis substantially coincides with the anilox roller axis, that is, coincides exactly with the anilox roller axis or extends parallel to the anilox roller axis with the distance between the second pivoting axis and anilox roller axis being less than 50 mm, wherein the body part support assembly comprises:

a central pivoting shaft which is connected with the associated frame part and an axis of which extends in the imaginary curve symmetry plane and is parallel to the plate cylinder axis, wherein the central pivoting shaft is so connected with the body part that the body part is at least pivotable about the central pivoting axis; and an actuator assembly which engages the body part and which is configured for pivoting the body part about the first pivoting axis and the second pivoting axis.

2. The printing module according to claim 1, wherein the actuator assembly is arranged for pivoting the body part of the first plate cylinder holder assembly and for pivoting the body part of the second plate cylinder holder assembly, wherein the actuator assembly is provided with a coupler, which has a coupled condition in which the pivoting of the first and the second body part is coupled and which have an uncoupled condition in which the pivoting of the first and second body part independently of each other is possible.

3. The printing module according to claim 2, wherein the actuator assembly comprises:

a first eccentric cam which engages an eccentric support surface of the body part, which is located opposite the supporting ring support surface, said eccentric support surface extending substantially perpendicular to the body part plane, wherein the eccentric cam is rotatable about a first eccentric axis which extends substantially parallel to the plate cylinder axis;

a second eccentric cam which also engages eccentric support surface of the body part and which is rotatable about a second eccentric axis which extends substantially parallel to the plate cylinder axis, wherein the first and the second eccentric cams and the associated first and second eccentric axes are mirror-symmetrically positioned with respect to the curve symmetry plane; and a slot in the body part in which the pivoting shaft is received, the slot having a width substantially corresponding to the diameter of the central pivoting shaft and having a length greater than the diameter of the central pivoting shaft, wherein the slot in the length direction has a longitudinal axis which is in the curve symmetry plane, such that the body part is not only pivotable about the central pivoting shaft but also translatable along the central pivoting shaft.

4. The printing module according to claim 1, wherein the actuator assembly comprises:

a first eccentric cam which engages an eccentric support surface of the body part, which is located opposite the supporting ring support surface, said eccentric support surface extending substantially perpendicular to the body part plane, wherein the eccentric cam is rotatable about a first eccentric axis which extends substantially parallel to the plate cylinder axis;

a second eccentric cam which also engages eccentric support surface of the body part and which is rotatable about a second eccentric axis which extends substantially parallel to the plate cylinder axis, wherein the first and the second eccentric cams and the associated first and second eccentric axes are mirror-symmetrically positioned with respect to the curve symmetry plane; and a slot in the body part in which the pivoting shaft is received, the slot having a width substantially corresponding to the diameter of the central pivoting shaft and having a length greater than the diameter of the central pivoting shaft, wherein the slot in the length direction has a longitudinal axis which is in the curve symmetry plane, such that the body part is not only pivotable about the central pivoting shaft but also translatable along the central pivoting shaft.

5. The printing module according to claim 4, further comprising:

a first eccentric cam connecting shaft which is connected with the first eccentric cam of the second plate cylinder holder assembly and which extends from the second frame part to the first frame part and which near the first frame part is provided with a first operating knob with the aid of which the first eccentric cam of the second plate cylinder holder assembly is adjustable;

a second eccentric cam connecting shaft which is connected with the second eccentric cam of the second plate cylinder holder assembly and which extends from the second frame part to the first frame part and which near the first frame part is provided with a second operating knob with the aid of which the second eccentric cam of the second plate cylinder holder assembly is adjustable;

a third operating knob which is connected with the first eccentric cam of the first plate cylinder holder assembly and with the aid of which the first eccentric cam of the first plate cylinder holder assembly is adjustable; and a fourth operating knob which is connected with the second eccentric cam of the first plate cylinder holder assembly and with the aid of which the second eccentric cam of the first plate cylinder holder assembly is adjustable.

6. The printing module according to claim 5, wherein the actuator assembly is arranged for pivoting the body part of the first plate cylinder holder assembly and for pivoting the body part of the second plate cylinder holder assembly, wherein the actuator assembly is provided with a coupler, which has a coupled condition in which the pivoting of the first and the second body part is coupled and which have an uncoupled condition in which the pivoting of the first and second body part independently of each other is possible, and wherein the coupler comprises:

a first coupling between the third operating knob and the first eccentric cam connecting shaft or the first operating knob mounted thereon, wherein the first coupling is co configured that in a coupled condition of the first coupling the two first eccentric cams are operated simultaneously and in an uncoupled condition of the first coupling are operable independently of each other; and a second coupling between the fourth operating knob and the second eccentric cam connecting shaft or the second operating knob mounted thereon, configured such that in a coupled condition of the second coupling the two second eccentric cams are operated simultaneously and in an uncoupled condition of the second coupling are operable independently of each other.

7. The printing module according to claim 1, wherein each plate cylinder holder assembly is provided with an associated hold-down which engages the supporting ring or a freely accessible part of the stationary shaft.

8. The printing module according to claim 7, wherein each hold-down comprises a piston-cylinder assembly and an associated pull rod, wherein the pull rod near an end is provided with a hook which in a retracted condition engages said freely accessible part of the stationary shaft, such that the supporting rings are pulled or pushed against the supporting ring support surface.

9. The printing module according to claim 8, wherein the pull rod of each hold-down is further provided with a bearing surface which engages said freely accessible part of the stationary shaft, such that the plate cylinder assembly is lifted and the supporting rings are moved away from the supporting ring support surface of the body part.

10. The printing module according to claim 8, further comprising:

a first eccentric cam connecting shaft which is connected with the first eccentric cam of the second plate cylinder holder assembly and which extends from the second frame part to the first frame part and which near the first frame part is provided with a first operating knob with the aid of which the first eccentric cam of the second plate cylinder holder assembly is adjustable;

a second eccentric cam connecting shaft which is connected with the second eccentric cam of the second plate cylinder holder assembly and which extends from the second frame part to the first frame part and which near the first frame part is provided with a second operating knob with the aid of which the second eccentric cam of the second plate cylinder holder assembly is adjustable;

a third operating knob which is connected with the first eccentric cam of the first plate cylinder holder assembly and with the aid of which the first eccentric cam of the first plate cylinder holder assembly is adjustable; and a fourth operating knob which is connected with the second eccentric cam of the first plate cylinder holder assembly and with the aid of which the second eccentric cam of the first plate cylinder holder assembly is adjustable, wherein the pull force exerted by the pull rods of the hold-downs is taken up via the supporting rings and the body parts by said eccentric cams.

11. A printing machine comprising a number of printing modules arranged in series behind each other, wherein at least one of the printing modules is the printing module according to claim 1.

12. A printing module comprising:

a frame which comprises two opposite frame parts;

an anilox roller which is bearing-mounted in the frame in a manner rotatable about an anilox roller axis and extends between the two opposite frame parts;

an impression roller which is bearing-mounted in the frame in a manner rotatable about an impression roller axis and extends between the two opposite frame parts;

a plate cylinder assembly comprising:

a stationary shaft;

two supporting rings which are each connected with the shaft near an associated end of the shaft; and a plate cylinder which is mounted on the shaft in a manner rotatable about a plate cylinder axis, the diameter of the plate cylinder substantially corresponding to the diameter of the supporting rings;

a first and a second plate cylinder holder assembly which are each connected with an associated frame part, and which are each configured for removably placing and fixing therein a supporting ring of the plate cylinder assembly;

wherein each plate cylinder holder assembly comprises:

a plate-shaped body part which extends in an imaginary body part plane which extends perpendicular to the plate cylinder axis, wherein a side of the plate-shaped body part proximal to the plate cylinder axis forms a supporting ring support surface which extends substantially perpendicular to the body part plane and runs along a curve which extends in the body part plane, wherein the curve is mirror-symmetrical with respect to an imaginary curve symmetry plane which extends substantially perpendicular to the body part plane and with respect to which the anilox roller axis and impression roller axis are substantially symmetrically positioned and in which the plate cylinder axis extends, wherein the curve, viewed from the plate cylinder axis, comprises:

a central concave curve part which is symmetrical with respect to the central curve symmetry plane;

a first convex curve part which adjoins a first end of the concave curve part and which extends to a first convex free end; and a second convex curve part which adjoins a second end of the concave curve part and which extends to a second convex free end, the two convex parts being symmetrical with respect to the curve symmetry plane; and a body part support assembly via which the body part is connected with the associated frame part, wherein the body part support assembly is configured for pivoting the body part about a first pivoting axis and for pivoting the body part about a second pivoting axis, wherein the first and second pivoting axes are symmetrically positioned on opposite sides of the curve symmetry plane, wherein the first pivoting axis substantially coincides with the impression roller axis, that is, coincides exactly with the impression roller axis or extends parallel to the impression roller axis with the distance between the first pivoting axis and impression roller axis being less than 50 mm, and wherein the second pivoting axis substantially coincides with the anilox roller axis, that is, coincides exactly with the anilox roller axis or extends parallel to the anilox roller axis with the distance between the second pivoting axis and anilox roller axis being less than 50 mm wherein each plate cylinder holder assembly is provided with an associated hold-down which engages the supporting ring or a freely accessible part of the stationary shaft, wherein each hold-down comprises a piston-cylinder assembly and an associated pull rod, wherein the pull rod near an end is provided with a hook which in a retracted condition engages said freely accessible part of the stationary shaft, such that the supporting rings are pulled or pushed against the supporting ring support surface, a first eccentric cam connecting shaft which is connected with the first eccentric cam of the second plate cylinder holder assembly and which extends from the second frame part to the first frame part and which near the first frame part is provided with a first operating knob with the aid of which the first eccentric cam of the second plate cylinder holder assembly is adjustable;

a second eccentric cam connecting shaft which is connected with the second eccentric cam of the second plate cylinder holder assembly and which extends from the second frame part to the first frame part and which near the first frame part is provided with a second operating knob with the aid of which the second eccentric cam of the second plate cylinder holder assembly is adjustable;

a third operating knob which is connected with the first eccentric cam of the first plate cylinder holder assembly and with the aid of which the first eccentric cam of the first plate cylinder holder assembly is adjustable; and a fourth operating knob which is connected with the second eccentric cam of the first plate cylinder holder assembly and with the aid of which the second eccentric cam of the first plate cylinder holder assembly is adjustable, wherein the pull force exerted by the pull rods of the hold-downs is taken up via the supporting rings and the body parts by said eccentric cams.

* * * * *